United States Patent [19]

Dunn et al.

[11] Patent Number: 4,774,431

[45] Date of Patent: Sep. 27, 1988

[54] ARC TUBE WIRE SUPPORT

[75] Inventors: John P. Dunn, Bath; Kent L. Collins; Norman R. King, both of Hammondsport, all of N.Y.

[73] Assignee: North American Philips Lighting Corp., New York, N.Y.

[21] Appl. No.: 912,452

[22] Filed: Sep. 29, 1986

[51] Int. Cl.[4] ..... H01J 61/36

[52] U.S. Cl. ..... 313/50; 313/54; 313/331; 313/623; 174/50.54; 174/50.55; 439/612

[58] Field of Search ..... 313/623, 624, 625, 631, 313/574, 331, 350, 247, 292, 269, 50, 51, 318, 25, 332, 17; 439/612; 174/50.52, 50.54, 50.55, 50.6, 50.64

[56] References Cited

U.S. PATENT DOCUMENTS

| | | | |
|---|---|---|---|
| 3,609,437 | 9/1971 | Tol et al. | 313/634 X |
| 4,366,410 | 12/1982 | Buhrer | 313/625 X |
| 4,507,584 | 3/1985 | Coaton et al. | 313/623 X |
| 4,621,216 | 11/1986 | Liebe et al. | 313/623 X |
| 4,628,225 | 12/1986 | Keim et al. | 313/574 X |

FOREIGN PATENT DOCUMENTS

| | | | |
|---|---|---|---|
| 0064175 | 5/1977 | Japan | 313/625 |
| 61-118955 | 6/1986 | Japan . | |

*Primary Examiner*—David K. Moore
*Assistant Examiner*—Michael Horabik
*Attorney, Agent, or Firm*—Robert T. Mayer

[57] ABSTRACT

A high pressure discharge lamp arrangement in which the support wire for the arc tube of the lamp has its end which is inserted in the open tubular electrode structure of the lamp expanded so that its external dimension more nearly equals the internal dimension of the tubular structure.

4 Claims, 1 Drawing Sheet

ARC TUBE WIRE SUPPORT

This is invention in the lighting arts. More particularly it involves an improvement in high pressure discharge lamps.

This invention is related to that disclosed and claimed in our concurrently filed patent application entitled "Method of Making Support Means for Discharge Lamp Tubes" which is assigned to the assignee of this application. That application is incorporated by reference herein.

In high pressure discharge lamps the arc tubes are typically held in place by support wires. In addition to supporting the tubes, these wires also serve as locating elements. A novel locating and supporting arrangement is shown in copending application Ser. No. 810,804 "U.S. Pat. No. 4,689,518" assigned to the assignee of this application. As shown in that application the locating and supporting wires are inserted into the open ends of the niobium tubes which form part of the electrode structure for the lamps. In the past, the difference between the diameter of the wire support and the internal dimension of the opening in the niobium tube allowed for lateral movement of the tube about the wire.

It is an object of this invention to reduce the lateral movement between an arc tube and its support wires.

One of the features of the invention is the expansion of that portion of a support wire which is inserted into the opening of a niobium tube. In this way the dimension of that portion of the support wire nearly equals the internal dimension of the opening of the niobium tube but still allows sufficient clearance for operational expansion and contraction.

One of the advantages of the invention is that it can provide center line alignment between the arc tube and its support wire.

In carrying out the invention there is provided in a high pressure discharge lamp both discharge means and support means for supporting the discharge means. At one end of the discharge means is a tubular electrode structure with an opening having a specified internal dimension. The supporting means includes a support wire having an external diameter smaller than said internal dimension. The support wire is of a prescribed length and formed with one end which is inserted in the opening of the tubular electrode structure. A portion of said one end before insertion is further formed into an expanded end means whose width nearly equals the internal dimension of the tubular electrode structure. The expanded end means provides a prescribed alignment for the discharge means. It also provides more lateral support for the discharge means than the wire would provide if said portion were not further formed into the expanded end means.

Other objects, features and advantages of the invention will be apparent to those skilled in the art from the following description and appended claims when considered in conjunction with the accompanying drawing in which:

The drawing is not to scale. Similar elements of the structures disclosed are identified by the same reference characters in the various figures of the drawing.

Figure 1:
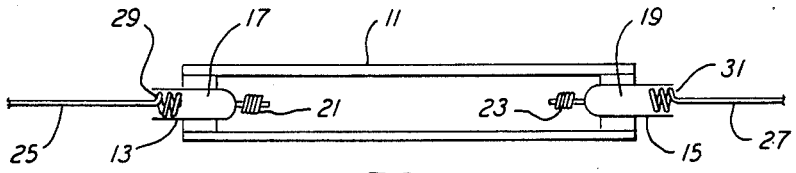
FIG. 1 is a partial view of a high pressure discharge lamp showing one embodiment of the invention.

Referring to FIG. 1 of the drawing there is shown a discharge means in the form of an arc tube 11 having electrode structures 13 and 15 at each of its ends. As is typical these structures include niobium tubes 17 and 19 and electrodes 21 and 23. The support means for arc tube 11 includes support wires 25 and 27 each having a prescribed length which could be different for each wire depending on the lamp design. Wires 25 and 27 are depicted as two separate wires but could be two ends of a single prescribed length of support wire which would later be cut in two.

In the FIG. 1 embodiment of the invention the ends of support wires 25 and 27 which are inserted in the open ends of niobium tubes 17 and 19 are coiled in order to form expanded end means whose external dimensions nearly equal the internal dimension of the niobium tubes. The expanded end means can provide centerline alignment between the discharge means and the support wires. They also provide more lateral support than wires 25 and 27 would provide without expanded end means.

Figure 2:
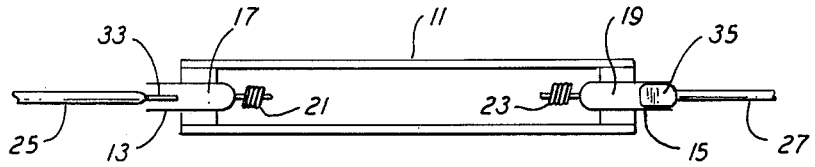
FIG. 2 is a partial view of a high pressure discharge lamp showing another embodiment of the invention.

FIG. 2 shows an arrangement similar to FIG. 1. Instead of coiling the ends of support wires 25 and 27 to form coiled portions 29 and 31 as in FIG. 1, however, the ends of support wires 25 and 27 are crimped to form flat portions 33 and 35. It is to be understood that the edges of flat portions 33 and 35 are so disposed that they are at approximately right angles to each other.

Figure 3:
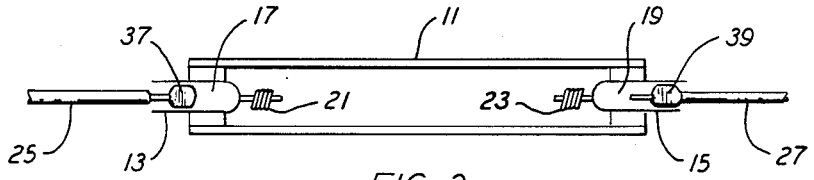
FIG. 3 is a partial view of a high pressure discharge lamp showing yet another embodiment of the invention.
Figure 4A:
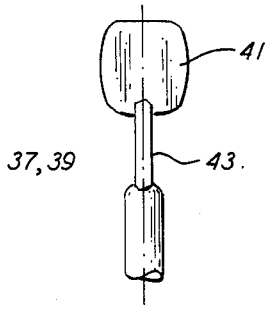
FIGS. 4*a* and 4*b* are orthogonally arranged views of a part of the embodiment of FIG. 3.
Figure 4B:
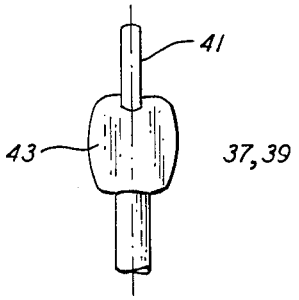

FIG. 3 shows the presently preferred embodiment of the invention. In this embodiment flat portions 33 and 35 of the arrangement of FIG. 2 are replaced by dual flattened end portions 37 and 39. As can be seen from FIGS. 4*a* and 4*b* each of these axial sections comprises two flattened portions 41 and 43 with rounded edges disposed at approximately right angles to each other. Flattened portions 41 and 43 are readily provided at the ends of wires 25 and 27 by crimping the ends of these wires as desired. It is contemplated that more than two flattened portions could be provided at the ends of each of wires 25 and 27. If so these might be arranged at different angles from the 90° angle shown in FIGS. 4*a* and 4*b*.

It is understood that various modifications to the above described arrangement of the invention will become evident to those skilled in the art and that the arrangements described herein are for illustrative purposes and are not to be considered restrictive.

What is claimed is:

1. In a high pressure discharge lamp including a discharge means with an end, support means for said discharge means, a tubular electrode structure with an opening with a specified internal dimension, said tubular electrode structure being located at said end of said discharge means, said support means including a support wire having a diameter smaller than said internal dimension, said support wire having a prescribed length and being formed with one end which is inserted in said opening of said tubular electrode structure, said support wire having a portion of said one end further formed into an expanded end means whose width nearly equals said internal dimension, said expanded end means providing a prescribed alignment for said discharge means and more lateral support than said wire would if said portion were not further formed into said expanded end means, said expanded end means of said support wire comprising flattened wire in at least two adjacent axial sections, said sections being disposed angularly with respect to each other as viewed along the axis of said wire.

2. In a high pressure discharge lamp according to claim 1 wherein said expanded end means of said support wire comprises flattened wire in two adjacent axial sections each disposed at approximately 90° to each other as viewed along the axis of said wire.

3. In a high pressure discharge lamp according to claim 1 wherein said discharge means has two ends, wherein a tubular electrode structure with an opening with a specified internal dimension is located at each end of said discharge means and said support means includes two support wires, each said support wire having a prescribed length and being formed with an end which is inserted in a respective opening in an associated tubular electrode structure, each said support wire having a portion at its said end further formed into an expanded end means whose width nearly equals the internal dimension of its respective opening, each said expanded end means providing a prescribed alignment for said discharge means and more lateral support than its respective wire would if its associated portion were not further formed into said expanded end means, wherein said expanded end means of each support wire comprises flattened wire in at least two adjacent axial sections, said sections disposed angularly with respect to each other as viewed along the axis of said wire.

4. In a high pressure discharge lamp according to claim 3 wherein said expanded end means of each support wire comprises flattened wire in two adjacent axial sections each disposed at approximately 90° to each other as viewed along the axis of said wire.

* * * * *